United States Patent [19]

Tolleson

[11] Patent Number: 5,039,163

[45] **Date of Patent: * Aug. 13, 1991**

[54] REINFORCED FLEXIBLE BACKREST ASSEMBLY FOR A CHAIR

[75] Inventor: Thomas H. Tolleson, Morristown, Tenn.

[73] Assignee: Shelby Williams Industries, Inc., Morristown, Tenn.

[ * ] Notice: The portion of the term of this patent subsequent to Sep. 26, 2006 has been disclaimed.

[21] Appl. No.: 404,749

[22] Filed: Sep. 8, 1989

Related U.S. Application Data

[63] Continuation-in-part of Ser. No. 244,663, Sep. 14, 1988, Pat. No. 4,869,552.

[51] Int. Cl.[5] ..... A47C 7/44

[52] U.S. Cl. ..... 297/297; 297/306; 297/299

[58] Field of Search ..... 297/285, 296, 297, 299, 297/300, 302, 306

[56] References Cited

U.S. PATENT DOCUMENTS

| | | | |
|---|---|---|---|
| 4,408,800 | 10/1983 | Knapp | 297/306 X |
| 4,580,836 | 4/1986 | Verney | 297/DIG. 2 X |
| 4,744,600 | 5/1988 | Inoue | 297/300 X |

FOREIGN PATENT DOCUMENTS

| | | | |
|---|---|---|---|
| 298088 | 4/1954 | Switzerland | 297/297 |
| 311751 | 12/1955 | Switzerland | 297/297 |

*Primary Examiner*—Peter R. Brown

*Attorney, Agent, or Firm*—Silverman, Cass & Singer, Ltd.

[57] ABSTRACT

A chair including a seat assembly having depending leg members and a hollow support frame having at least two open ends terminating beneath the seat assembly and a pair of upstanding, spaced apart hollow frame members arranged to provide a backrest frame part for the chair having at least two open ends extending beneath the seat assembly and in registry with the ends of the support frame, and flexible spring members secured between each pair of members to provide an articulated, flexible spring backrest for the chair beneath the seat assembly. Each flexible spring member includes an elongated, flat or blade spring member having its opposite ends secured within a holder member which is closed at one end and open at its opposite end for inserting the spring into the holder. The open ends of each holder having stop flange formations protruding outwardly thereon which, when the holders are spaced apart at their open ends with a slight gap therebetween, effect limitation of the angle of flexure of the spring by engagement of the flanges one with the other. Each open end of the support frame can include hollow frame segments secured adjacent thereto for registry with complementary hollow frame segments secured adjacent the open ends of the backrest frame members which include like spring members secured therebetween where the segments and spring members are contained beneath the seat assembly.

14 Claims, 3 Drawing Sheets

FIG. 1
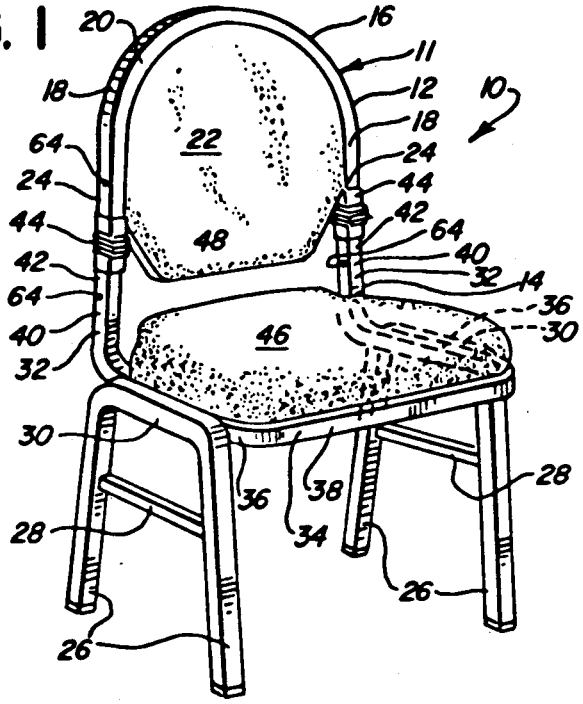
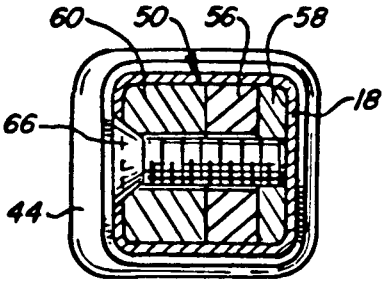
FIG. 4
FIG. 2
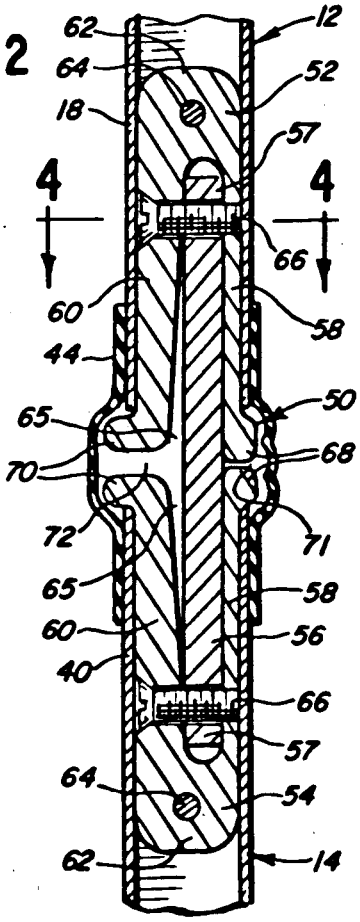
FIG. 3
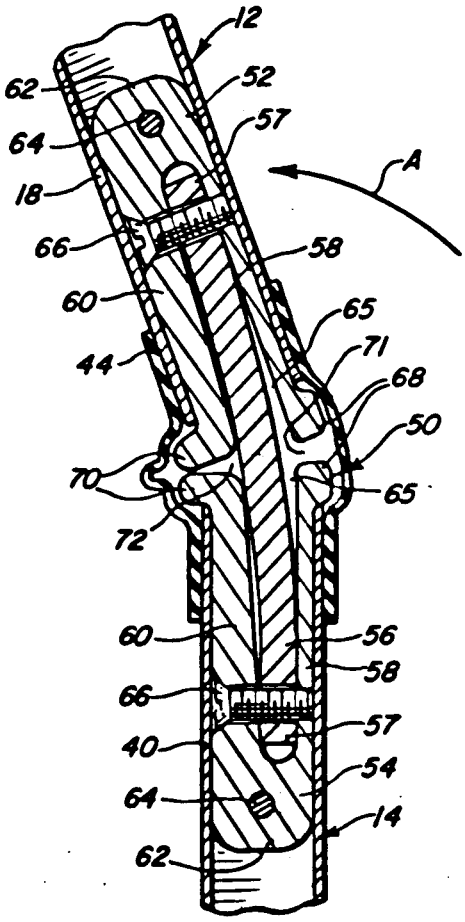

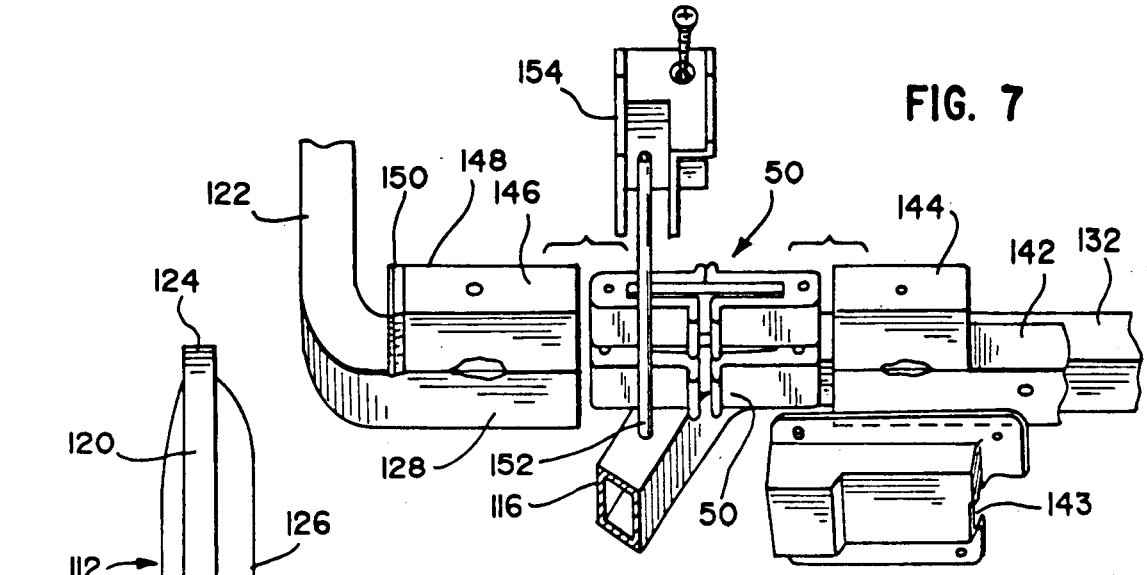
FIG. 7
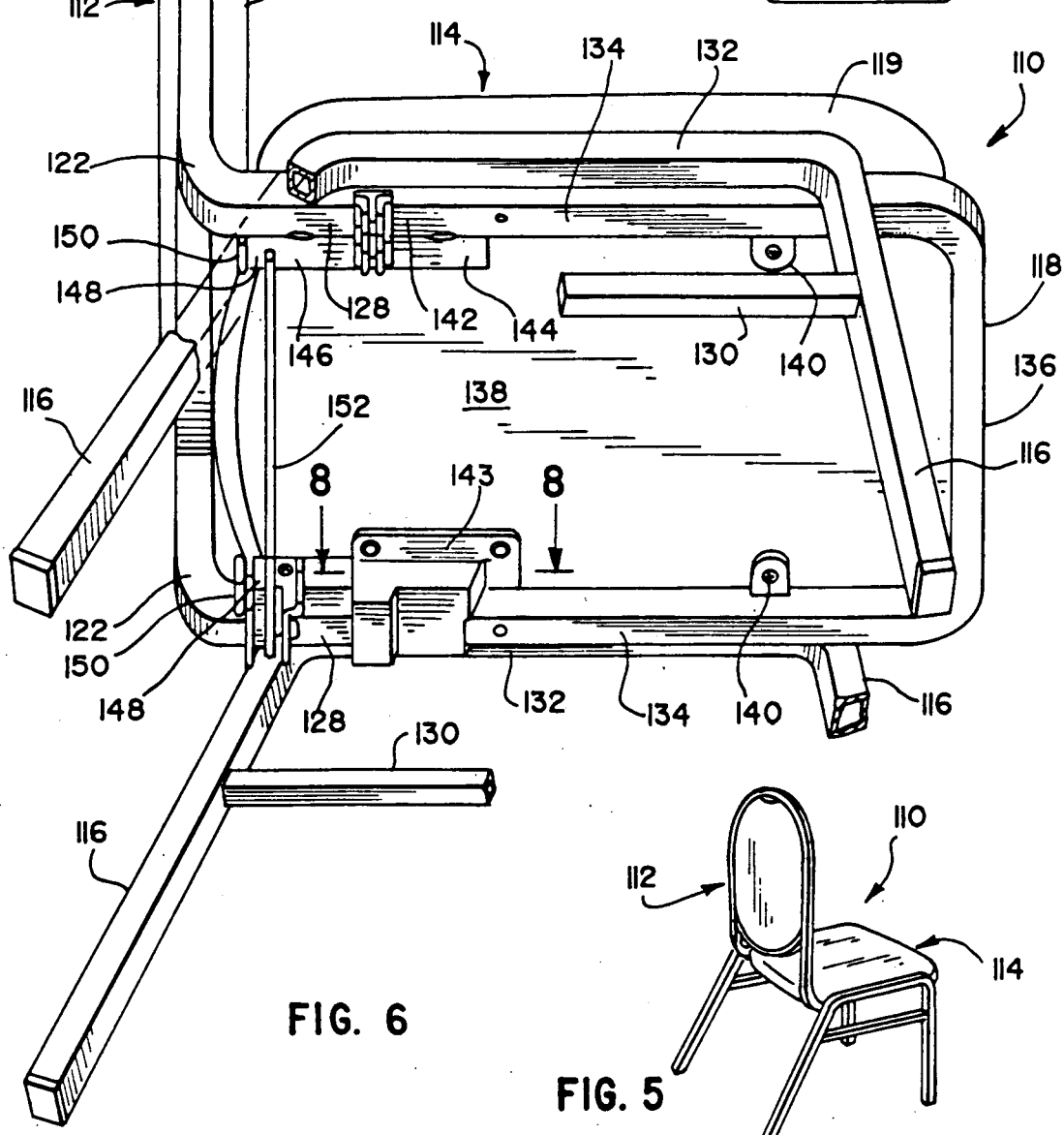
FIG. 6
FIG. 5

REINFORCED FLEXIBLE BACKREST ASSEMBLY FOR A CHAIR

RELATED APPLICATION

This application is a continuation-in-part of U.S. Ser. No. 07/244,663 filed Sept. 14, 1988, the disclosure of which is incorporated herein by reference. The related applications are owned by a common assignee.

FIELD OF THE INVENTION

This invention relates generally to chairs having flexible, articulated backrests and more particularly, to a chair frame having a backrest frame part joined to the bottom surface of the seat portion of the chair by a reinforced flexible spring assembly.

BACKGROUND OF THE INVENTION

Chairs having articulated, flexible backrest parts for achieving desired support and comfort for the user are known in the art. Such chairs are used, for example, in banquet and conference facilities where back comfort for the seated individual is desirable. Chairs of this type typically are stackable and have molded backrest parts and peripheral frame parts of hollow construction to enable interconnection of upper and lower backrest parts which are flexible one relative to the other. Various types of flexible spring arrangements for joining the upper and lower backrest parts of such chairs are known. An example of such a spring arrangement is disclosed in U.S. Pat. No. 4,603,904 which is assigned to the same assignee as the assignee herein.

The chair disclosed in U.S. Pat. No. 4,603,904 includes an articulated, flexible backrest having a spring means that includes an elongated plastic support strut having a hollow passageway that is fitted with a flexible core. The flexible core comprises a wire cable or the like whose structural specification is selected to limit to some degree the flexing angle of the backrest's upper part. The spring means serve positively to join the upper and lower backrest portions to prevent translational movement therebetween. As the spring means are flexed, the wire cable secured in the passageway of the plastic support strut limits the elongation and ultimate yield or breaking point of the strut. The cable controls elongation of the strut to permit flexing and yet prevents tensile failure by insuring that the plastic support strut is not flexed beyond the tensile limit of the material from which it is constructed. A problem encountered with this structure derived from change in characteristics of the wire cable and spring strut after extended periods of time or unusual use or abuse.

Thus, it is desired to avoid such problems by providing a flexible spring assembly which includes specially constructed holder means for the spring having restrictive engagement means which will not change in function characteristics and yet prevent flexing of the spring beyond the tensile limit of the material from which it is constructed. One such flexible spring assembly is disclosed in parent application Ser. No. 07/244,663 entitled FLEXIBLE BACKREST ASSEMBLY FOR A CHAIR which is incorporated herein by reference. The flexible backrest assembly of herein invention includes a flexible reinforced spring assembly which joins a backrest frame part directly to the bottom surface of the seat portion thereby concealing the spring assembly beneath the seat portion to provide a more aesthetically pleasing appearance while reducing interference with the spring assembly.

SUMMARY OF THE INVENTION

A chair having a seating frame which includes a backrest frame portion upstanding thereon, the backrest portion being connected to a support frame beneath the seating frame by a pair of substantially identical flexible spring members. Each spring member includes an elongated, flat or blade spring, preferably of laminated structure, having opposite ends. Each end of the spring is secured within a holder or channel member which is closed at one end and open at its opposite end for inserting the spring into the holder. The spring is secured within a holder or channel member adjacent the closed end thereof and offset laterally from the longitudinal axis of the holder or channel. The open ends of each holder have stop flange formations protruding outwardly thereof. When the spring is secured in a pair of holders, the holders are spaced apart at their open ends a predetermined distance or gap to effect limitation of the angle of flexure of the spring because of restrictive engagement of the flanges one with the other when the spring means are installed between the upper and lower backrest frame portions.

The backrest frame portion includes two lateral, hollow, peripheral depending open frame ends and the support frame portion has two lateral, hollow, peripheral open frame ends beneath the seating frame. The depending frame ends are arranged to be aligned, respectively, with the support frame ends beneath the seating frame. The flexible spring members preferably are installed partially within the interior of the hollow, aligned peripheral frame ends of the backrest portion and support frame to extend outwardly from open extremities of the frame ends. The flanges of the holders are exposed exterior of the backrest frame portion and support frame for effecting the restrictive movement engagement thereof so as to prevent the blade spring from flexing beyond the tensile limit of the material from which it is constructed.

Each open end of the support frame can include hollow frame segments rigidly secured adjacent thereto for registry with complementary hollow frame segments secured adjacent the open ends of the backrest frame members which include like spring members secured therebetween, the segments and the spring members being contained beneath the seat assembly. A stop member also can be included for assisting in preventing rearward movement of the backrest beyond a desired position.

BRIEF DESCRIPTION OF THE DRAWINGS

FIG. 1 is a perspective view of a chair having the flexible spring assembly embodying the invention of the parent application installed between the backrest frame portions thereof;

FIG. 2 is a fragmentary longitudinal sectional view of a portion of the backrest frame portions of the chair having the flexible spring assembly installed, the backrest frame portions being in a non-flexed or at rest position;

FIG. 3 is a fragmentary view similar to that of FIG. 2 illustrating the backrest frame portions in flexed displacement;

FIG. 4 is a sectional view taken along line 4—4 of FIG. 2 and in the direction indicated generally;

FIG. 5 is a perspective view of the rear of the chair having the reinforced spring assembly of the invention concealed beneath the seat bottom;

FIG. 6 is a perspective view of the bottom of the chair having the reinforced spring assembly embodying the invention installed beneath the seat bottom;

FIG. 7 is an enlarged exploded view of one of the reinforced spring assemblies of FIG. 6;

DESCRIPTION OF THE PREFERRED EMBODIMENTS

Figure 8:
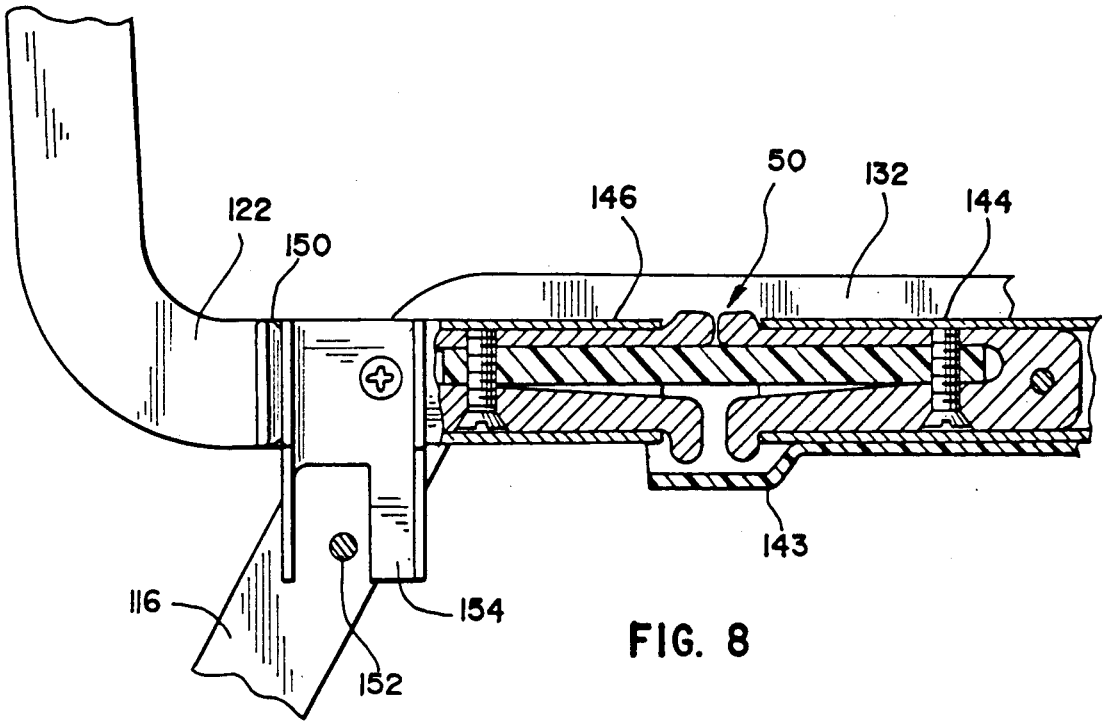
FIG. 8 is a sectional view taken along line 8—8 of FIG. 6 and in the direction indicated generally, illustrating a spring assembly in its non-feted position.

FIGS. 1–4 are the FIGS. and corresponding disclosure of the parent application Ser. No. 07/244,663 incorporated herein by reference. The spring means 50 also are utilized with the chair of the present invention.

Referring to FIG. 1, the chair is designated generally by the reference numeral 10. Chair 10 includes a frame 11 having an upper backrest portion designated generally 12 and a unitary seat and lower backrest portion designated 14.

The upper backrest portion 12 includes a peripheral, inverted U-shaped frame member 16 providing a pair of spaced apart, depending frame member ends 18 connected across the upper ends thereof by a curved bridging segment 20. A backrest pad or cushion 22 is secured between the frame member ends 18. Each frame member end 18 has lower extremities 24 that are open or hollow. The frame member 16 is formed of metal stock or tubing and has a cross-sectional configuration which can be rectangular, circular, or any other suitable configuration. The frame member 16 also can be formed from a suitable strong, molded synthetic plastic or composition material so long as it is rigid and hollow. Additionally, the frame member 16 can be of any suitable configuration other than the U-shape that is illustrated.

The unitary seat and lower backrest portion 14 includes a unitary frame assembly formed of hollow tubular stock similar to that of the frame member 16. The assembly includes a pair of like inverted U-shaped members, each providing a pair of depending legs 26 braced by a cross-member 28. Each pair of legs 26 is connected by an upper saddle or bridge segment 30. The bridging segments 30 are spaced apart the distance between the conjoined leg pairs 26.

A combination seat and lower backrest frame 32 is secured between the bridging or saddle segments 30. The combination frame 32 likewise is formed of tubular stock and includes a horizontally oriented seat-retaining portion 34 of generally U-shaped configuration and an upstanding backrest portion formed as an extension of the seat portion 34. The seat portion 34 includes a pair of side segments 36 connected at the front end of the chair by a front segment 38. Extending upwardly from each side segment 36 at the rear end of the chair 10 are straight segments 40 which are hollow and open at their respective upper extremities 42. The segments 40 are arranged in parallel relationship and are spaced apart laterally the same distance as the depending frame member ends 18. The upstanding segments 40 thereby cooperate to provide the lower backrest frame portion of the chair 10. As FIG. 1 illustrates, the members 18 and 40 are interconnected, i.e., each member 18 is aligned and is in registry with a respective member 40. The joint or juncture between each of the interconnected members 18 and 40 is concealed by a bellows-like appearing flexible sleeve 44 so that the backrest 12 of the chair 10 appears to be unitary. A seat pad or cushion 46 is installed on the seat frame members 36 and 38. The backrest pad 22 can include an optional lower backrest pad portion 48 positioned between the lower backrest segments 40. The chair construction is such that the lower backrest portion 48 can be omitted, if desired, without sacrificing the utility of the chair, or a separate pad, not shown, can be installed.

FIGS. 2–4 illustrate flexible spring means embodying the invention for conjoining or connecting the upper and lower backrest frame portions 12 and 14. A pair of identical spring means is installed on a chair so that only one need be described in detail. Each of said spring means 50 includes an upper holder member 52, a lower holder member 54, and a substantially non-extensible flexible insert comprising a flat or blade spring 56 secured at opposite ends 57 thereof within the two holders 52 and 54.

The holders 52 and 54 are substantially identical in construction and configuration. Each is a channel formation or generally U-shaped having opposing leg members 58 and 60 joined by a connecting member 62 at end thereof. The upper and lower holder or channel members 52 and 54 are positioned within the open frame ends 18 and 40 respectively and are secured therein by fasteners 64 that extend through the frame ends 18 and 40. Preferably, the channel members 52 and 54 are rigid and are made of aluminum, but can be made of any desired material so long as they restrict movement and function as described. The end 65 of a holder opposite its closed end formed by connecting member 62 is open for receiving the blade spring 56.

The flat or blade spring 56 is elongated and is secured at its respective ends 57 within the channel members 52 and 54 by fasteners 66. As best seen in FIG. 4, each end 57 of the blade spring 56 is secured within a channel member 52 offset from the longitudinal center line or axis of the channel member. The spring 56 is positioned in closer proximity to the front facing leg 58 of the holder because of the desired greater flex or travel of the spring in one direction away from the front end of the chair 10. As seen in FIGS. 2 and 3, spring 56 can enable the desired flexing of the upper backrest portion 12 relative to the lower backrest portion 14 in the direction of arrow A. Spring 56 preferably is a laminated blade or flat spring, but other spring materials may be feasible so long as the desired flexing and strength is provided.

To limit the bending of the upper backrest portion 12 relative to the lower backrest portion 14, the distal ends of each leg member 58 and 60 are formed with outwardly extending flanges 68 and 70. Preferably, the leg members 58 are positioned facing toward the front of the chair 10 and are slightly longer than the leg members 60 which are positioned facing toward the rear of the chair 10. Additionally, the flanges 70 can extend outwardly a greater distance than the flanges 68 so as to provide a more effective limitation to the backward motion of the upper backrest portion 12 typically encountered during use. As illustrated, the flanges 68 and 70 not only limit the desired bending of the backrest frame portions one relative to the other, but they also serve stop formations against which the open ends of the frame members 18 and 40 engage or abut when the channel members 52 and 54 are inserted therein.

To assemble the spring means 50, the flat spring 56 is inserted within the channel members 52 and 54 and is secured therein by the fasteners 66 to form a single unit. Thereafter, the upper channel member 52 is inserted within the open end of the frame member 18 and the lower channel member 54 is inserted within the open end of the frame member 40. The fasteners 64 are then inserted within corresponding apertures in the frame members 18 and 40 and the channel members 52 and 54 to secure the channel members 52 and 54 within the frame members 18 and 40. In installing the spring means 50, due consideration to proper placement of bellows sleeve 44 will be given before the spring means 50 installation is completed.

In operation, when the upper backrest portion 12 is at rest position as illustrated in FIG. 2, the upper backrest portion 12 is maintained in vertical alignment with the lower backrest portion 14 by the spring means 50. Additionally, due to the length of the flat spring 56 and the positioning of the apertures for the fasteners 66, a slight gap 71 is provided between the two flanges 68 as well as a slight gap 72 between the two flanges 70 so as to permit flexing of the upper backrest portion 12 relative to backrest portion 14. Since the front leg 58 is slightly longer than the rear leg 60, the gap 72 between the flanges 70 is slightly larger than the gap 71 between the flanges 68. Accordingly, as FIG. 3 illustrates, upon rearward flexing of the upper backrest portion 12 along the line "A", the flange 70 of the upper backrest portion 12 rotates through the larger gap 72 until it engages against the flange 70 of the lower backrest portion 14 and restricts further rearward movement of the upper backrest portion 12. This larger angular displacement of the backrest portion 12 along the line "A" is achieved by reason of the spring 56 being secured in the holders 52 offset from the center line or axis of the aligned holders in a direction away from the flanges 70 and the larger gap 72 therebetween. This enables the spring 56 to be flexed a greater angular distance consistent with the larger gap 72 for movement of the backrest portion 12. Also to be noted is that the leg 60 of the holder is thicker than the opposing leg 58 for contributing to additional strength at the point of contact where angular movement of the portion 12 is stopped. By so securing the spring 56 offset in the holders 52, maximum strength and extent of angular travel of the spring is realized. Further maximum use of limited space available for the flexing or angular movement of the spring is permitted.

During the rearward flexing of the upper backrest portion 12, the flat spring 56 is displaced or flexed. When the user leans forward spring 56 causes automatic return of upper backrest portion 12 along the line "A" to its original at rest position. As upper backrest portion 12 returns to the rest position, flanges 68 restrict forward movement of the upper backrest portion 12 in a manner similar to that of the flanges 70. Since a large forward displacement of the upper backrest portion 12 is typically not desirable in normal use of the chair 10, the gap 71 between the flanges 68 can be smaller. It is to be noted, however, that the size of the flanges 68 and 70 as well as the gaps 71 and 72 between them and the length of the leg members 5B and 60 can vary so long as the spring means 50 functions as described.

In every position of the upper backrest portion 12, the sleeve or bellows 44 covers the gaps 71 and 72 between the flanges 68 and 70 and conceals the operative spring means 50.

The flexing or deflection of the spring means 50 enables the upper backrest frame part to be displaced from the normal plane of the backrest assembly or relative to the lower backrest frame part as illustrated by FIG. 3. This flexing or displacement of the upper backrest frame part relative to the lower frame part contributes to the desired feature for seating comfort. The chair back flexing features along with optimum user comfort as described in U.S. Pat. No. 4,603,904 commonly owned herewith likewise are realized by the herein spring means or assembly 50. The channel or holder members will retain their structural specifications over long periods of chair use while preventing undue flexing of the spring 56.

Referring to FIGS. 5–9, a reinforced chair frame embodying the invention is designated generally by the reference numeral 110. The chair 110 includes a backrest portion 112 and a seat assembly 114 including depending leg members 116, a support frame 118 and a seat cushion 119.

As FIG. 6 illustrates, the backrest portion 112 includes a peripheral, inverted U-shaped frame member 120 providing a pair of spaced apart, depending frame member ends 122 connected across the upper ends thereof by a curved bridging segment 124. A backrest pad or cushion 126 is secured between the frame member ends 122. Each frame member end 122 has a lower extremity 128 that is open or hollow and can be bent at an angle so that it can extend beneath the seat assembly 114 when assembled. The frame member 120 can be formed of metal stock or tubing and has a cross-sectional configuration which can be rectangular, circular or any other suitable configuration. The frame member 120 also can be formed from a suitable strong, molded synthetic plastic or composition material so long as it is rigid and includes the lower extremities 128. Additionally, the frame member 120 can be of any suitable configuration other than the U-shaped that is illustrated.

The seat assembly 114 preferably includes a pair of like inverted U-shaped members, each providing a pair of the depending legs 116 which are braced by a cross-member 130. Each pair of legs 116 is connected by an upper saddle or bridge segment 132 which is connected to opposite sides of the support frame 118, such as, for example, by welding.

The support frame 118 generally is U-shaped providing a pair of spaced apart arm members 134 connected across the front end of the chair 110 by a connecting member 136. The arm members 134 are secured to a bottom 138 of the seat cushion 119, such as, for example, by fasteners 140. The leg members 116, bridge segment 132, arm members 134 and connecting member 136 can be formed of hollow tubular stock similar to that of the frame member 120.

The arm members 134 include rear end portions 142 which are hollow and open at their respective rear extremities. The rear end portions 142 are arranged in parallel relationship and are spaced apart the same distance as the depending frame member ends 122. Thus, the members 142 and 122 are interconnected, i.e., each member 142 is aligned and is in registry with a respective lower extremity 128 of member 122. The joint or juncture between each of the interconnected members 142 and 122 can be concealed by a protective cover 143. If desired, each spring also can include a bellows-like flexible sleeve 44 as disclosed in the parent application in addition to or in place of the protective cover 143.

Figure 9:
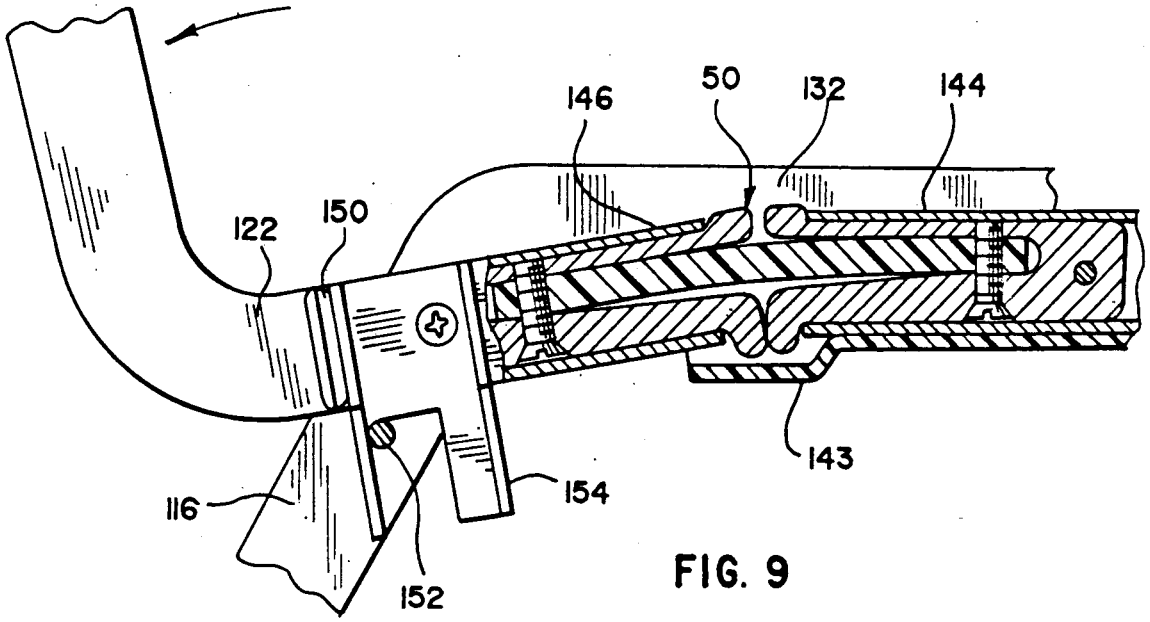
FIG. 9 is a sectional view similar to FIG. 8 illustrating a spring assembly in its flexed position.

As FIGS. 8 and 9 illustrate, in order to flexibly connect the rear portions 142 to their respective depending frame member ends 122, flexible spring means 50 as disclosed in the parent application are utilized. For clarity, FIGS. 8 and 9 include the appropriate reference numerals used in the parent application for describing the members of the spring means 50. Thus, reference is to be made to the above description of FIGS. 2–4 as provided in the parent application for details with regard to the structure of the spring means 50.

It is to be noted that, in FIGS. 5–9, the connections between the rear portions 142 and their respective depending frame member ends 122 are positioned beneath and are thus concealed by the seat assembly 114. This not only provides a more aesthetically pleasing design, but also reduces the risk of foreign elements being caught between the spring means 50 while enabling easier stacking of the chair 110, if desired.

As FIGS. 6 and 7 illustrate, in order to provide a reinforcement or stiffer support between the depending ends 122 and the rear portions 142, a second flexible connection can be utilized. The second connection can be provided on both sides of the support frame 118 and includes a first tubular segment 144 secured to the rear portion 142 of an arm member 134 and a second tubular segment 146 secured to the depending end 122 of the frame member 120. The segments 144 and 146 can be formed of hollow tubular stock similar to that of the frame member 120 and are rigidly secured to the respective members 122 and 142, such as, for example, by welding.

The segments 144 and 146 are in registry with one another and are interconnected by spring means 50. Thus, two spring means 50 are provided on each side of the support frame 118 to provide the desired reinforcement. The protective cover 143 also can enclose the spring means 50 of both of the segments 144 and 146 which also can include the bellows sleeve 44. The outside end 148 of the tube segment 146 can include a plug 150.

In order to prevent over-bending of the backrest portion 112, a rod 152 can be included which extends between opposite leg members 116 across the rear of the chair beneath the depending ends 122. The rod 152 serves to prevent over-flexing of the spring means 50 from an extreme force which cannot be effectively handled by the flanges 70 by providing a positive stop to the depending ends 122.

In order to inhibit any interference between the rod 152 and the depending ends 122, a U-shaped protective guard 154 can be positioned on each of the depending ends 122 with the rod 152 contained within the U-shaped portion of the guards 154. Thus, as FIGS. 8 and 9 illustrate, the guards 154 inhibit foreign material from entering between the rod 152 and the depending ends 122 in the unflexed and flexed positions.

The simplicity and economy of the spring means 50 and its installation can be readily appreciated. Simple tooling and parts are involved. Minor variations in dimensions and configuration of component parts of the invention may occur to the skilled artisan without departing from the scope of the invention as set forth in the appended claims.

I claim:

1. A chair comprising, a seat assembly which includes depending leg members and a hollow support frame having at least two open ends terminating beneath said seat assembly, a backrest frame part having a pair of spaced apart hollow frame members upstanding relative to the seat support frame and having at least two open ends extending beneath said seat assembly and arranged in registry with the ends of the support frame, and spring means secured between each registered pair of frame members beneath said seat assembly to provide an articulated, flexible spring backrest for the chair, each spring means including a pair of elongate holder members of like, substantially U-shaped configuration closed at one end thereof and open at the opposite end thereof, one leg of each holder member being thicker and shorter than the opposing leg thereof and facing towards the rear of the chair, a substantially non-extensible flexible spring secured off-center in said holder members relative to the longitudinal center line of said holder members and adjacent said closed ends thereof and extending through said open ends thereof between the holder members, said open ends facing toward and spaced one from the other to form a gap therebetween, said holder members being installed inside said registered pair of frame members with the flexible spring extending therebetween, said holder members each having flange means integrally formed on said legs adjacent said open ends of the holders and protruding outwardly of the open extremities and into the spacing between the frame parts, said flange means constructed and arranged to limit angular movement of the upper backrest part in diametrically opposite directions by interengagement between protruding opposing flange means whereby to limit flexing of the spring beyond the tensile limit thereof.

2. The chair as defined in claim 1 wherein said spring is a flat spring secured at its opposite ends adjacent the closed ends of the holder members.

3. The chair as defined in claim 2 wherein the legs of each of the holder members have integral flanges extending in a direction outwardly of the holder members and in opposite directions one relative to the other, said flanges on the thicker legs of the holder members being spaced apart a distance greater than the spacing between flanges on the thinner legs of the holder members and related to the offset securement of the spring in the holder members to enable a greater angular movement of said backrest part in the direction toward the rear end of the chair.

4. The chair as defined in claim 1 wherein each of said open ends of said seat assembly support frame include a hollow frame segment secured adjacent thereto for registry with complementary hollow frame segments secured adjacent said open ends of said backrest frame part and including said spring means secured between each registered pair of frame segments, said segments and said spring means being contained beneath said seat assembly.

5. The chair as defined in claim 4 wherein said seat assembly includes stop means connected to said seat assembly for engagement with said spaced apart frame members of said backrest for preventing rearward movement of said backrest beyond a desired position.

6. The chair as defined in claim 5 wherein said stop means includes a rod positioned beneath said seat assembly proximate to the rear thereof and extending between and secured to opposite rear leg members.

7. The chair as defined in claim 5 including a guard member connected to said seat assembly and covering said spring means and said open ends of said support frame and said backrest frame for inhibiting foreign material from entering between said frame members of said backrest and said stop means.

8. A chair comprising, a seat assembly which includes depending leg members and a hollow support frame having at least two open ends terminating beneath said seat assembly, a backrest frame part having a pair of spaced apart hollow frame members upstanding relative to the seat support frame and having at least two open ends extending beneath said seat assembly and arranged in registry with the ends of the support frame, and spring means secured between each registered pair of frame members beneath said seat assembly to provide and articulated, flexible spring backrest for the chair, said spring means including a pair of elongate holder members of like, substantially U-shaped configuration closed at one end thereof and open at the opposite end thereof, a substantially non-extensible flexible insert secured in said holder members adjacent said closed ends thereof and extending through said open ends thereof between the holder members, said open ends facing toward and spaced one from the other to form a gap therebetween, said holder members being installed relative to said registered pair of frame members so as to maintain the flexible insert extending therebetween, said opposite ends of the holder members each having cooperating restrictive flange engagement means integral therewith and extending outwardly of said open extremities for limiting flexing of the insert beyond the tensile limit thereof in diametrically opposite directions of movement of the backrest frame part relative to the front facing end of the chair.

9. The chair as defined in claim 8 wherein said holder members are secured within the interiors of said frame members and said flexible insert is a flat spring secured at its opposite ends in said holder members offset from the longitudinal center line or axis of the holder members.

10. The chair member as defined in claim 4 wherein said flat spring is a laminated member.

11. The chair as defined in claim said engagement means comprise a pair of flanges on said opposite ends of each of said holder members, each flange of the pair extending in a direction outwardly of said holder member and in opposite directions one relative to the other with the opposing flanges of opposite holder members being spaced one from the other to provide gaps therebetween.

12. The chair as defined in claim 11 wherein said holder members are constructed of a substantially rigid material so that upon flexing of said insert said flanges engage one another to limit the flexing of said insert.

13. The chair as defined in claim 12 wherein one flange of a pair of flanges is larger than the second flange of the pair, and the larger flange faces toward the rear end of the chair, the gap between said larger flanges being greater in width than that of the gap between the smaller flanges.

14. A chair comprising, a seat assembly which includes a seat portion, depending leg members and a hollow support frame secured to a bottom surface of said seat portion having at least two open ends terminating beneath said seat portion, a backrest frame part having a pair of spaced apart hollow frame members upstanding relative to the seat support frame and having at least two open ends extending beneath said seat portion and arranged in registry with the ends of the support frame, spring means secured between each registered pair of frame members beneath said seat portion to provide an articulated, flexible spring backrest for the chair, and a hollow frame segment secured adjacent each of said open ends of said seat assembly support frame for registry with complementary hollow frame segments secured adjacent said open ends of said backrest frame part and including spring means secured between each registered pair of frame segments, said segments and said spring means being contained beneath said seat assembly.

* * * * *

UNITED STATES PATENT AND TRADEMARK OFFICE

CERTIFICATE OF CORRECTION

PATENT NO. : 5,039,163

DATED : August 13, 1991

INVENTOR(S) : Thomas H. Tolleson

It is certified that error appears in the above-identified patent and that said Letters Patent is hereby corrected as shown below:

Column 3, line 11, delete "non-feted" and insert --non-flexed--;

Column 5, line 63, delete "5B" and insert --58--;

Column 9, line 38, delete "4" and insert --9--; and

Column 10, line 1, after "claim" insert --8 wherein--.

Signed and Sealed this

Sixth Day of October, 1992

*Attest:*

DOUGLAS B. COMER

*Attesting Officer*

*Acting Commissioner of Patents and Trademarks*